US009046304B2

(12) United States Patent
Gulak et al.

(10) Patent No.: US 9,046,304 B2
(45) Date of Patent: Jun. 2, 2015

(54) AIR DRYER

(71) Applicant: Paula Gulak, Richmond, VA (US)

(72) Inventors: Loren R. Gulak, Wilmington, NC (US); Morton B. Gulak, Richmond, VA (US)

( * ) Notice: Subject to any disclaimer, the term of this patent is extended or adjusted under 35 U.S.C. 154(b) by 175 days.

(21) Appl. No.: 13/670,023

(22) Filed: Nov. 6, 2012

(65) Prior Publication Data

US 2013/0111780 A1 May 9, 2013

Related U.S. Application Data

(60) Provisional application No. 61/628,853, filed on Nov. 8, 2011.

(51) Int. Cl.

| | |
|---|---|
| ***F26B 21/00*** | (2006.01) |
| ***F26B 7/00*** | (2006.01) |
| ***A47K 10/48*** | (2006.01) |

(52) U.S. Cl.

CPC ..... *F26B 21/003* (2013.01); *F26B 7/00* (2013.01); *A47K 10/48* (2013.01)

(58) Field of Classification Search

CPC ..... F26B 19/00; F26B 21/00; F26B 21/003; F26B 25/00; F26B 25/14; A45D 20/00; A45D 20/08; A45D 20/12

USPC ..... 34/380, 381, 413, 417, 427, 480, 497, 34/86, 90, 95, 229; 604/20, 23; 454/187; 392/384, 385

See application file for complete search history.

(56) References Cited

U.S. PATENT DOCUMENTS

| | | | | |
|---|---|---|---|---|
| 4,741,697 | A | 5/1988 | Herbison | |
| 5,038,769 | A * | 8/1991 | Krauser | 128/203.27 |
| 5,286,201 | A | 2/1994 | Yu | |
| 5,331,748 | A | 7/1994 | Miller, Jr. | |
| 5,394,620 | A | 3/1995 | Chimera | |
| 5,701,681 | A | 12/1997 | Wonka et al. | |
| 5,787,601 | A | 8/1998 | Stelly | |
| 6,312,403 | B1 | 11/2001 | Ruiz | |
| 6,718,650 | B2 | 4/2004 | Ross | |
| 6,732,449 | B2 | 5/2004 | Evanyk | |
| 6,885,810 | B2 | 4/2005 | Allwohn et al. | |
| 7,100,605 | B2 * | 9/2006 | Opitz | 128/202.25 |
| 7,172,418 | B2 | 2/2007 | Hamman | |
| 7,198,485 | B2 | 4/2007 | Hamman | |
| 7,204,038 | B2 | 4/2007 | Santhouse | |
| 7,806,083 | B2 | 10/2010 | Denison et al. | |
| 7,806,084 | B2 | 10/2010 | Denison et al. | |
| 8,201,344 | B2 | 6/2012 | Sawabe et al. | |
| 2004/0159001 | A1 | 8/2004 | Ross | |
| 2004/0192186 | A1 | 9/2004 | Bourgeois et al. | |
| 2008/0161749 | A1 * | 7/2008 | Houghton-Ward et al. | 604/23 |
| 2008/0253754 | A1 | 10/2008 | Rubin | |

(Continued)

FOREIGN PATENT DOCUMENTS

| | | | |
|---|---|---|---|
| GB | 1027097 | * | 4/1966 |
| JP | 2011149653 A | * | 8/2011 |
| WO | WO 9743997 A1 | * | 11/1997 |

*Primary Examiner* — Steve M Gravini

(74) *Attorney, Agent, or Firm* — Greenblum & Bernstein, P.L.C.

(57) ABSTRACT

An air dryer for supplying a decontaminated air stream. The air dryer includes a housing comprising a handle and an air frame body, a fan assembly structured and arranged in the air frame body, and an air filter arranged in the air frame body downstream of the fan assembly, wherein the air filter is structured and arranged to filter an incoming air stream to supply the decontaminated air stream.

18 Claims, 8 Drawing Sheets

(56) References Cited

U.S. PATENT DOCUMENTS

| | | | | |
|---|---|---|---|---|
| 2010/0024241 | A1 | 2/2010 | Cannetti | |
| 2010/0192399 | A1 | 8/2010 | Sawabe et al. | |
| 2010/0199513 | A1 | 8/2010 | Sanders | |
| 2010/0234794 | A1 | 9/2010 | Weadock et al. | |
| 2010/0280436 | A1 | 11/2010 | Self et al. | |
| 2011/0120492 | A1 | 5/2011 | Worthy | |
| 2011/0307039 | A1 | 12/2011 | Cornell | |
| 2012/0277662 | A1* | 11/2012 | Golkowski | 604/24 |
| 2013/0111780 | A1* | 5/2013 | Gulak et al. | 34/480 |

* cited by examiner

AIR DRYER

CROSS REFERENCE TO RELATED APPLICATION

The present application claims priority to U.S. Provisional Application No. 61/628,853 filed on Nov. 8, 2011, the disclosure of which is expressly incorporated by reference herein in its entirety.

FIELD OF THE INVENTION

The present invention relates to an air dryer, in particular, a hand held, portable air body dryer.

BACKGROUND OF THE INVENTION

Within a medical environment, for example, prior to surgery, a liquid solution, such as Betadine (povidone-iodine), for example, may be spread over a surgical area in order to clean, disinfect and/or reduce the possibility of infection at the incision site. Surgeons and nurses must wait for the solution to "air dry" (i.e., without external devices) before beginning their surgical procedures. The liquid solution may typically take three to four minutes to dry. This time delay results in lost efficiency and increased costs in the medical environment.

Accordingly, there exists a need for a method and system for reducing time delays and associated costs, and increasing efficiencies within medical environments.

SUMMARY OF EMBODIMENTS OF THE INVENTION

Embodiments of the present invention are directed to an air dryer, in particular, a hand held, portable air body dryer having a filtration system, and methods of use therefore. In particular embodiments, the apparatus includes a filtration system, for example, having a high efficiency particulate arresting (HEPA) air filter. In particular embodiments, the air dryer is designed ergonomically for hand-held comfort. In some embodiments, the air dryer is designed and structured such that air-flow is directed to a small area of the body intended for surgical purposes. In embodiments, the hand held, portable air body dryer may be used by doctors, nurses and other medical personnel to quickly dry a solution (e.g., Betadine) placed on the skin to sterilize the area in preparation for surgery. In embodiments, the air dryer may be used in hospitals and care facilities where clean air may be needed to dry areas of sensitive skin.

In certain embodiments, the method includes using an air dryer to distribute clean air over the wet surgical solution in order to dry the solution. According to aspects of the invention, this will reduce drying time, and thus increase the efficiency of the procedure. For example, patients will be under anesthesia for less time as a result and over a number of surgeries operating rooms can be used more efficiently. The dryer may also be used in clinics and doctor's offices when preparatory solutions are need prior to small surgical procedures. The air dryer will provide a tremendous service by proactively reducing waiting time for surgical work to begin.

In further embodiments, the method includes using an air dryer to distribute clean air to localized areas of a person in order to dry the localized area while avoiding any abrasion associated with towel drying, e.g., to dry areas of sensitive skin. Implementing aspects of the present invention provides healthy drying conditions and provides comfort for patients through its soothing air flow. For example, care givers may utilize the air dryer on certain patients after bathing when toweling, for example, might cause irritation to the skin.

Aspects of the present invention are directed to an air dryer for supplying a decontaminated air stream. The air dryer comprises a housing comprising a handle and an air frame body, a fan assembly structured and arranged in the air frame body, and an air filter arranged in the air frame body downstream of the fan assembly, wherein the air filter is structured and arranged to filter an incoming air stream to supply the decontaminated air stream.

In particular embodiments, the air filter comprises a HEPA filter.

In embodiments, the air dryer further comprising a battery operable to power the fan assembly.

In further embodiments, the battery comprises a rechargeable battery.

In additional embodiments, the air frame body includes one or more slots structured and arranged for receiving the incoming air stream.

In particular embodiments, the air frame body includes an air chamber arranged downstream of the fan assembly, that is structured and arranged for receiving the incoming air stream.

In embodiments, the air frame body includes a filter chamber structured and arranged to accommodate the air filter.

In further embodiments, the air dryer further comprises an end cap structured and arranged for removable attachment to the air frame body, wherein the end cap maintains the air filter in the filter chamber.

In additional embodiments, the air dryer further comprises a UV lighting arrangement structured and arranged to disinfect the incoming air stream.

In particular embodiments, the air dryer further comprises a heating arrangement structured and arranged to heat the incoming air stream.

In embodiments, the air dryer is structured and arranged as a portable air dryer.

In further embodiments, the housing further comprises a base platform structured and arranged between the handle and the air frame body.

In additional embodiments, the housing comprises plastic.

In particular embodiments, the fan assembly comprises a fan, a motor structured and arranged to rotate the fan, and a fan housing.

In embodiments, the air dryer further comprises a power switch operable to actuate the fan assembly.

Aspects of the present invention are directed to a method of using a portable air dryer to supply a decontaminated air stream. The method comprises activating the air dryer to generate the decontaminated air stream and supplying the decontaminated air stream to a liquid material disposed on a patient. The supplying the decontaminated air stream to the liquid material accelerates a drying of the liquid material.

In particular embodiments, the liquid material comprises a liquid solution for a surgical procedure, and the method further comprises applying the liquid solution to the patient.

In further embodiments, the liquid material comprises water.

In additional embodiments, the air dryer comprises a housing comprising a handle and an air frame body, a fan assembly structured and arranged in the air frame body, and an air filter arranged in the air frame body downstream of the fan assembly, wherein the air filter is structured and arranged to filter an incoming air stream to supply the decontaminated air stream.

In yet further embodiments, the air filter comprises a HEPA filter.

BRIEF DESCRIPTION OF THE FIGURES

For a more complete understanding of the invention, as well as other objects and further features thereof, reference may be had to the following detailed description of the invention in conjunction with the following exemplary and non-limiting drawings wherein.

DETAILED DESCRIPTION OF EMBODIMENTS OF THE INVENTION

Figure 1:
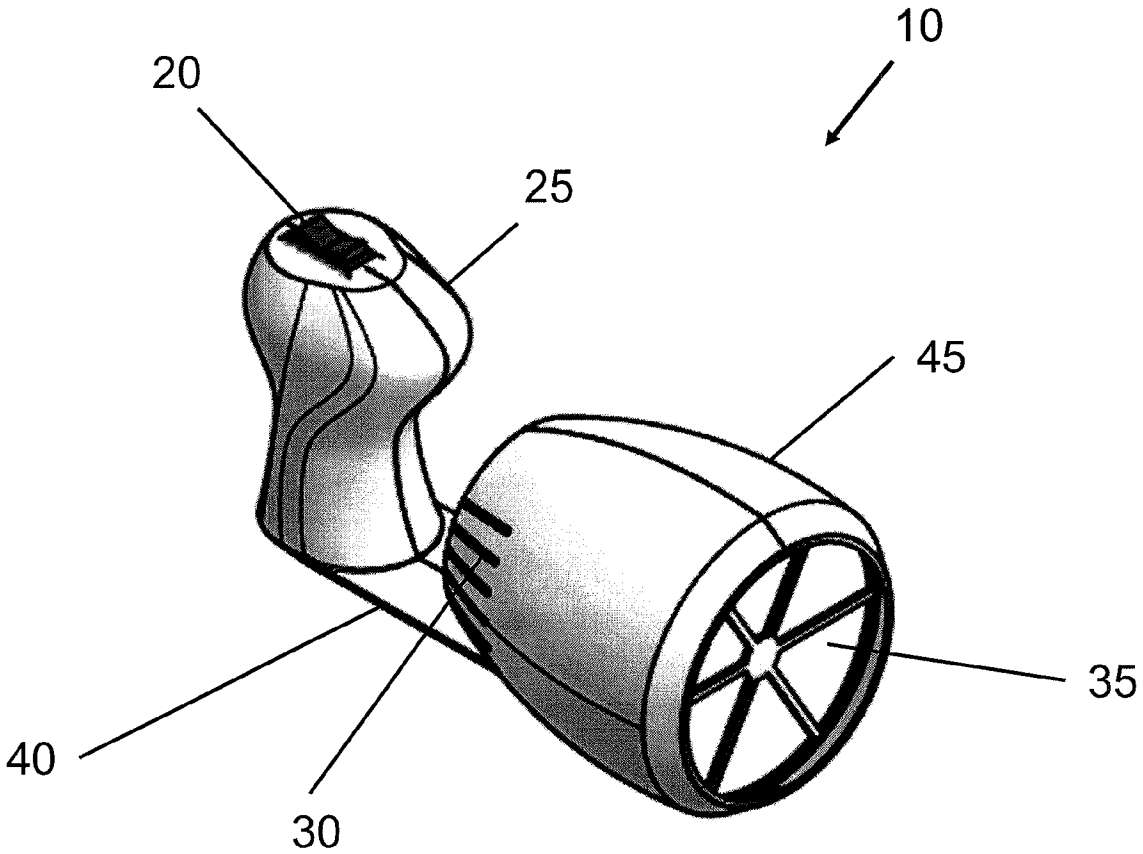
FIG. 1 illustrates a perspective view of an exemplary body dryer in accordance with aspects of the present invention.

In the following description, the various embodiments of the present invention will be described with respect to the enclosed drawings. The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

The various embodiments disclosed herein can be used separately and in various combinations unless specifically stated to the contrary.

Embodiments of the present invention are directed to an air dryer, in particular, a hand held, portable air body dryer having a filtration system, and methods of use therefore. In particular embodiments, the filtration system includes a high efficiency particulate arresting (HEPA) air filter to provide for sanitation and cleanliness of the supplied air stream.

Conventional air dryers are not suitable for medical environments. Conventional air dryers are divided into those that dry hair (i.e., hair dryers) and those that dry the body after a shower or bath (i.e., body dryers). Hair dryers, however, do not supply filtered (e.g., cleaned) air and, therefore, are not appropriate for medical use. That is, supplying unfiltered air to an incision area in a surgical environment may, for example, cause debris to enter an incision, and cause infection. Likewise, portable body dryers do not supply filtered (e.g., cleaned) air and, therefore, are not appropriate for medical use. For example, one portable body dryer (U.S. Pat. No. 5,394,620) does not provide for sanitation and cleanliness of the supplied air stream. Generally, body dryers are stationary devices bolted to a wall such that a person may stand in the direction of the blowing air. Moreover, hair dryers and body dryers may produce a wide spread stream of air that would not be easy to control in a medical situation. For example, U.S. Pat. No. 5,394,620 is designed for self drying with nozzle choices for drying all parts of the body.

Embodiments of the present invention are directed to an air dryer, in particular, a hand held, portable air body dryer having a filtration system that is suitable for medical uses (e.g., that provides for sanitation and cleanliness of the supplied air stream). In particular embodiments, the filtration system includes a high efficiency particulate arresting (HEPA) air filter to provide for sanitation and cleanliness of the supplied air stream.

FIGS. 1-4 illustrate various views of an exemplary body dryer 10 in accordance with aspects of the present invention. As shown in FIG. 1, a switch 20 on the top of a handle 25 turns the air dryer 10 on and off. Outside air is drawn through one or more slots 30 in the frame and propelled by a fan (not shown) through a filter 35, e.g., a HEPA filter, which is structured and arranged to remove dust and/or other room particles (e.g., contaminants). Clean air is then supplied from the air dryer 10, and makes contact with the patient. In particular embodiments, the shape of the handle 25 is designed, structured, and arranged to be ergonomically comfortable for holding and maneuvering the air dryer 10. A base platform 40 arranged between the handle 25 and the air frame body 45 is structured and arranged to accommodate the electric wires connecting the switch 20 and battery (not shown) to the motor (not shown).

In accordance with aspects of the invention, the dryer 10 is portable and powered by a battery (e.g., a rechargeable battery) In such embodiments, the dryer 10 is structured and arranged to be removable from a charging base (not shown) for remote use. In such embodiments, the dryer 10 does not require external electric wires (e.g., AC power wires and plug) that may get in the way of a surgical preparation area, making the dryer 10 safe and convenient. While the exemplary dryer 10 does not include external electric wires, the invention contemplates an air dryer including external electric wires. In embodiments, the dryer 10 (or components of the dryer 10, e.g., the outer casing) may be made of plastic for ease of cleaning and to reduce the weight of the dryer 10.

Figure 2:
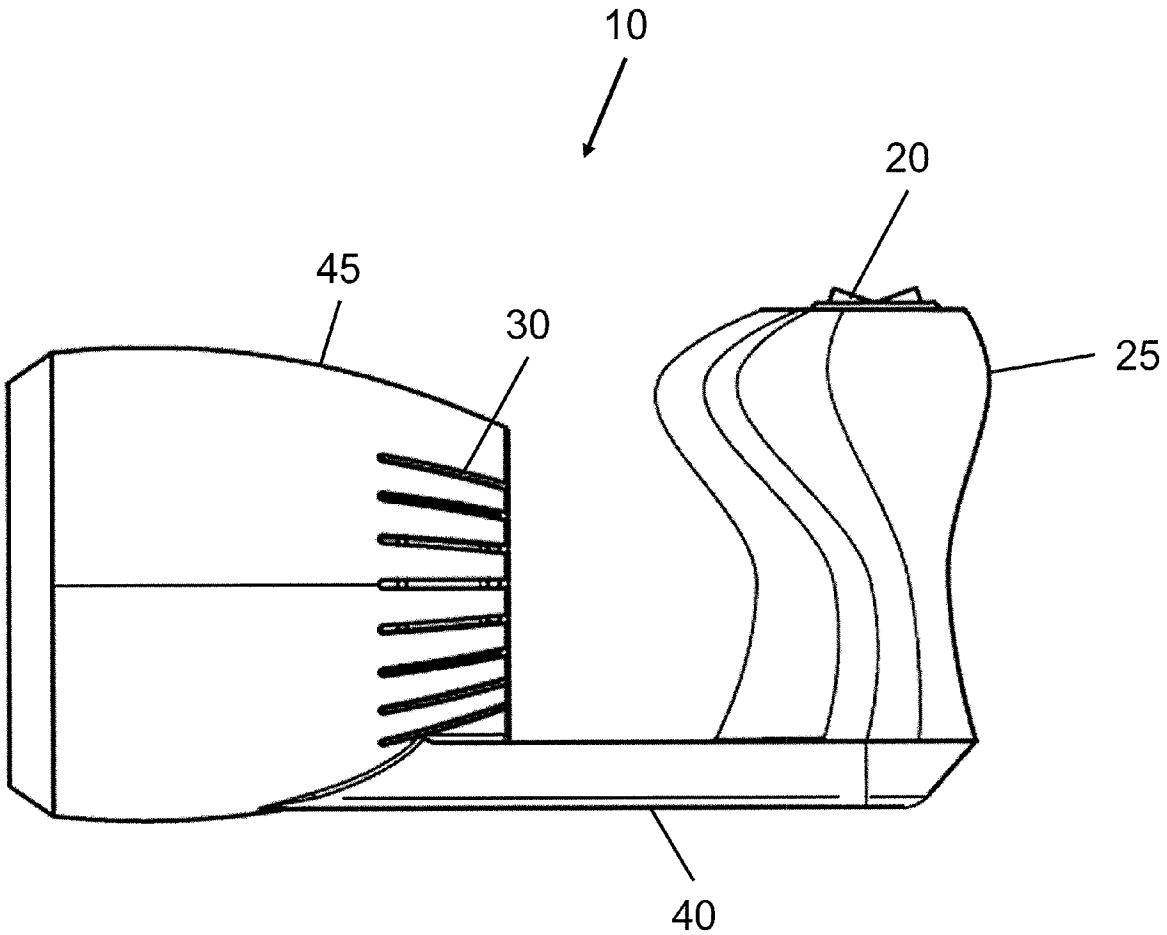
FIG. 2 illustrates a side view of the exemplary body dryer in accordance with aspects of the present invention.
Figure 3:
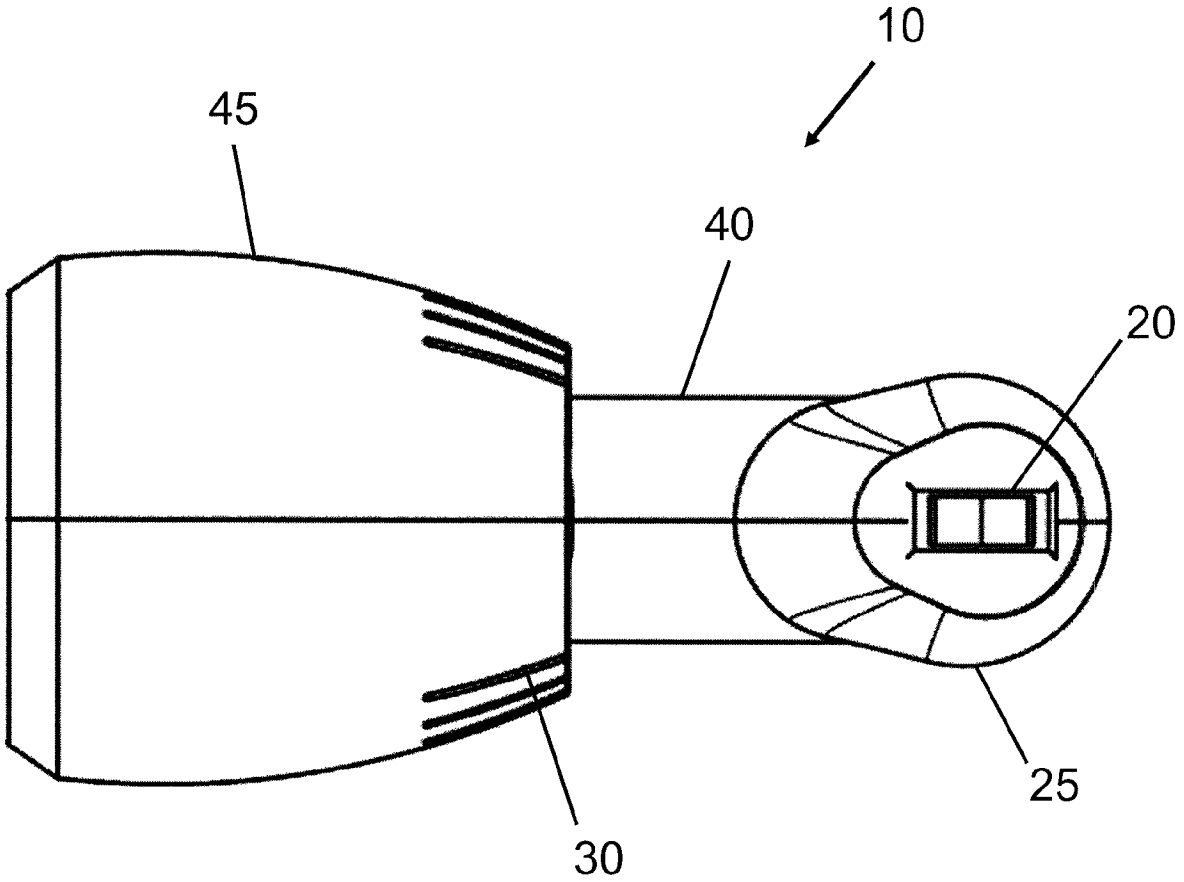
FIG. 3 illustrates a top view of the exemplary body dryer in accordance with aspects of the present invention.
Figure 4:
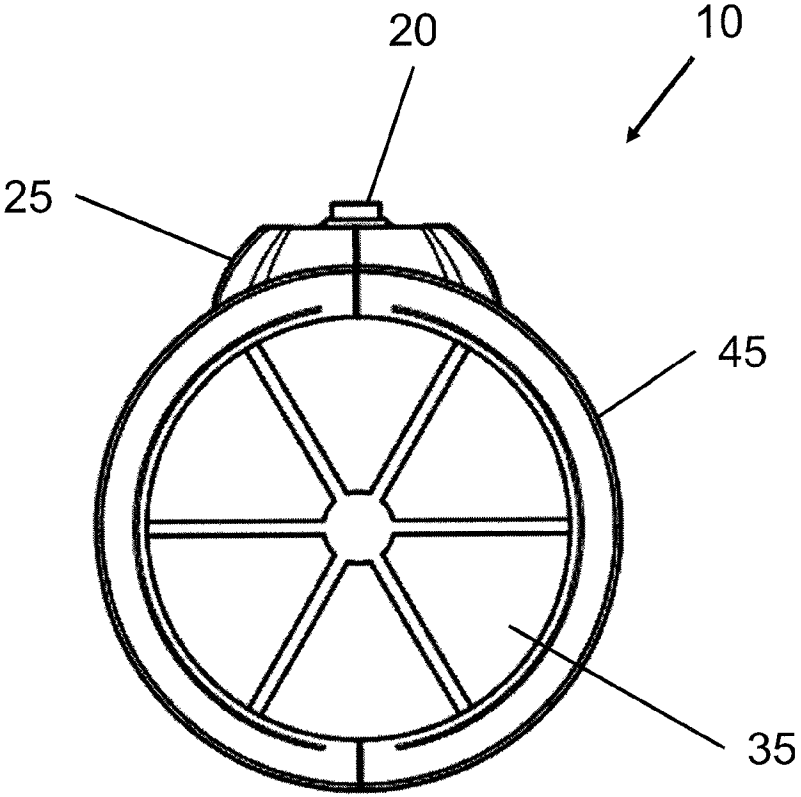
FIG. 4 illustrates a front view of the exemplary body dryer in accordance with aspects of the present invention.

FIGS. 2-4 illustrate, respectively, a side view, a top view, and a front view of the exemplary body dryer 10 in accordance with aspects of the present invention. As shown in FIGS. 2 and 3, the dryer 10 includes the base platform 40 arranged between the handle 25 and the air frame body 45. A switch 20 on the top of the handle 25 is operable to turn the air dryer 10 on and off. Outside air is drawn through the one or more slots 30 in the air frame body 45, and propelled by a fan (not shown) through a HEPA filter 35, both of which are located in the air frame body 45.

Figure 5:
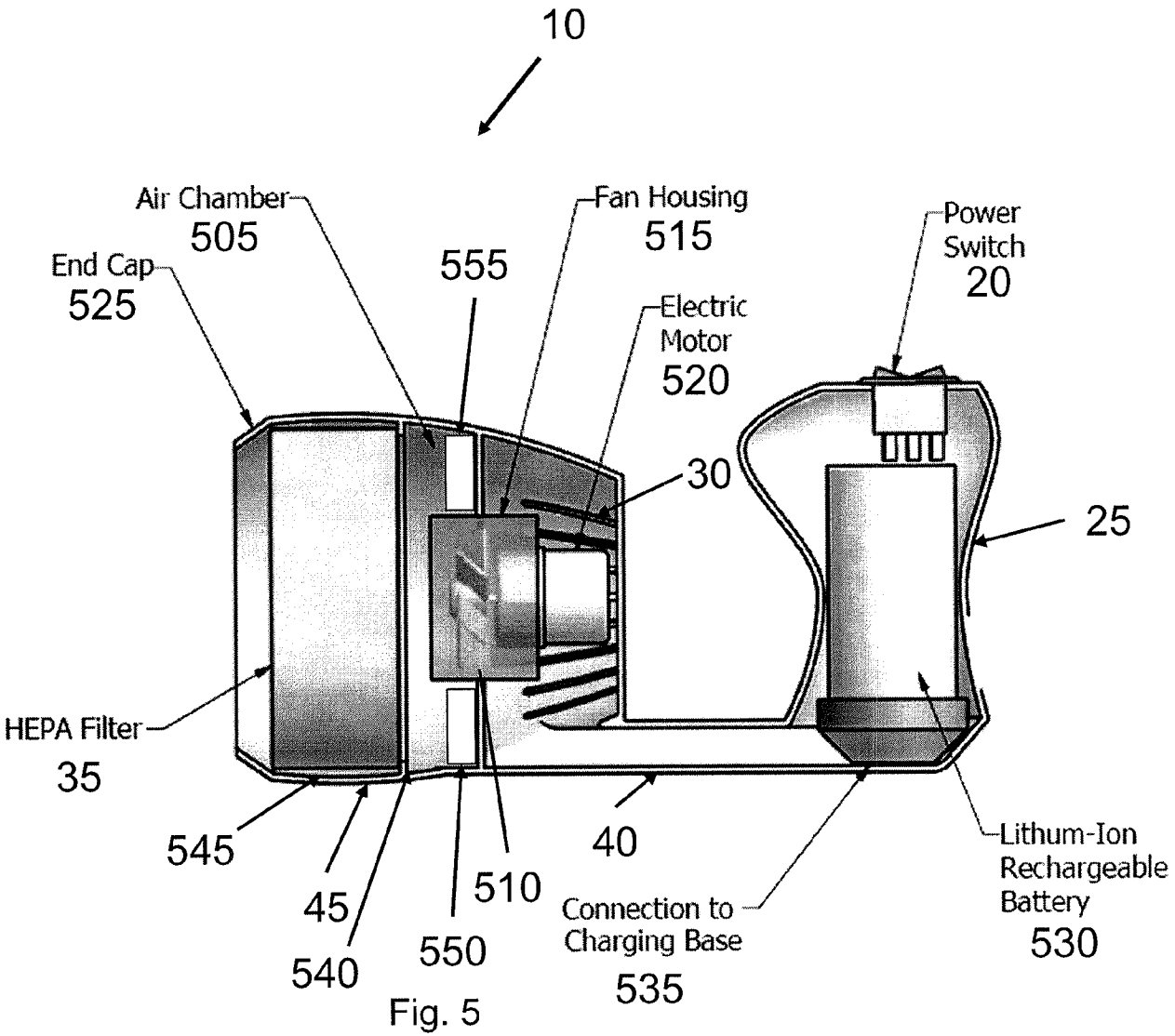
FIG. 5 illustrates a side cut-away view of the exemplary body dryer with the HEPA filter, which shows an exemplary air flow side of the dryer in accordance with aspects of the present invention.

FIG. 5 illustrates a side cut-away view of the exemplary body dryer 10 with the HEPA filter 35. As shown in FIG. 5, the dryer 10 includes the base platform 40 arranged between the handle 25 and the air frame body 45, and a switch 20 on the top of the handle 25, which is operable to turn the air dryer 10 on and off. Outside air is drawn through the one or more slots 30 in the air frame body 45, and propelled by a fan 510 through the HEPA filter 35. As shown in FIG. 5, a fan assembly may include the fan 510 arranged in a fan housing 515 and an associated electric motor 520.

The handle 25 is structured and arranged to accommodate a battery 530, e.g., a lithium-ion rechargeable battery, with other batteries (e.g., non-rechargeable, or Ni-Cad batteries) contemplated by the invention. The base platform 40 is structured and arranged with a connection 535 to a charging base (not shown).

The air frame body 45 includes an air chamber 505 structured and arranged downstream of the fan 510 and upstream of the HEPA filter 35. The HEPA filter 35 is arranged in a filter chamber 545 at the end of the air frame body 45. As shown in FIG. 5, the HEPA filter 35, when positioned within the filter chamber 545, may be maintained in proper position through abutment against a stop 540 and an end cap 525. In embodiments, the end cap 525 may be removable (e.g., through a threaded connection or friction fit) so that the filter may be arranged within the filter chamber. The filter 35 may be removed for replacement or cleaning by twisting-off the end cap 525 from the air frame body 45. In other embodiments, the end cap 525 may be made of a material sufficiently elastically deformable and/or malleable to allow for placement (and removal) of the filter 35 in the filter chamber 545.

Figure 6:
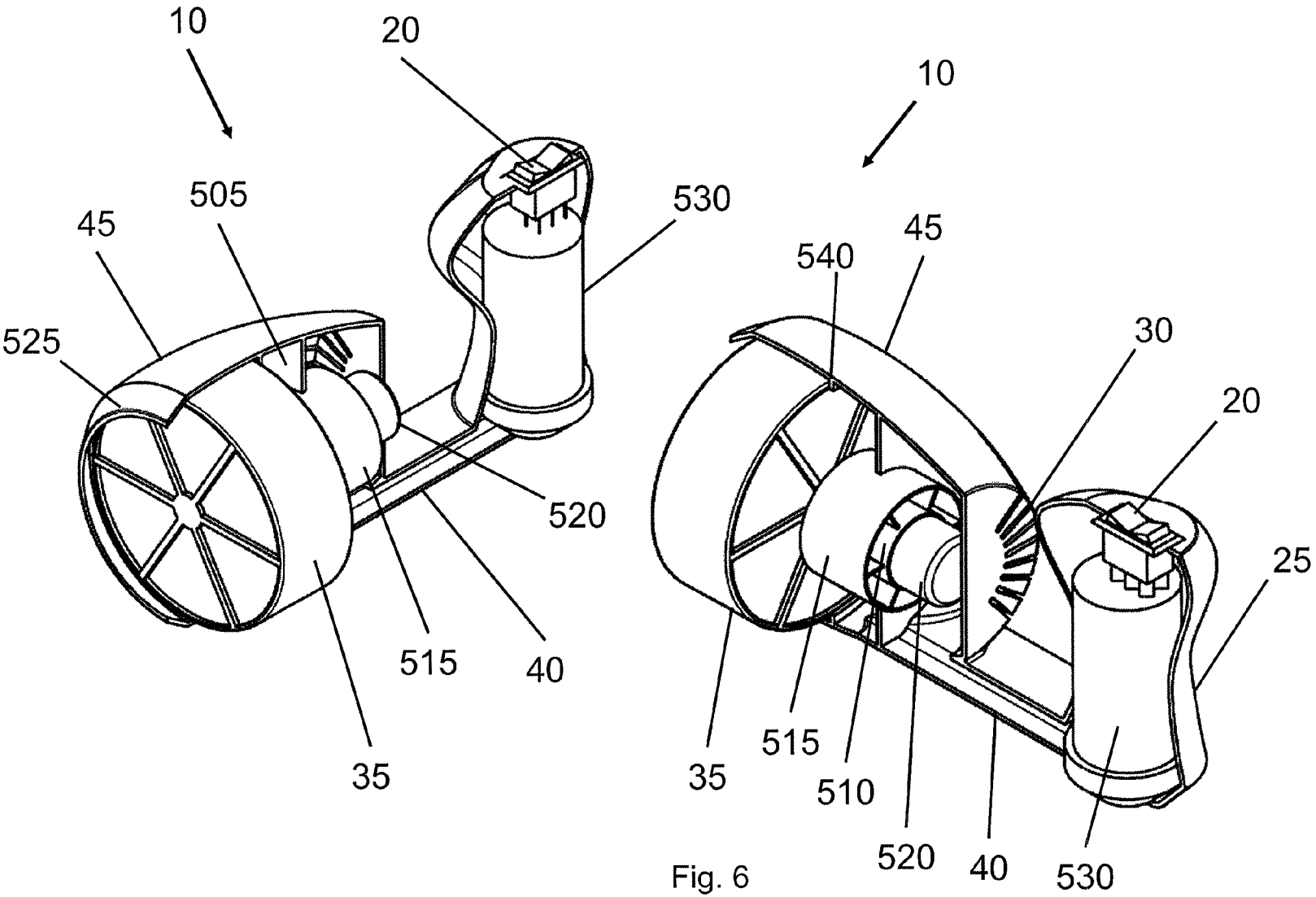
FIG. 6 illustrates perspective cut-away views of the exemplary body dryer in accordance with aspects of the present invention.

FIG. 6 illustrates perspective cut-away views of the exemplary body dryer 10 in accordance with aspects of the present invention. As shown in FIG. 6, the dryer 10 includes the base platform 40 arranged between the handle 25 and the air frame body 45. The switch 20 on the top of the handle 25 is operable to turn the air dryer 10 on and off. Outside air is drawn through the one or more slots 30 in the air frame body 45, and propelled by the fan 510 through the HEPA filter 35. As shown in FIG. 6, the fan assembly includes the fan 510 arranged in the fan housing 515 with an associated electric motor 520.

As additionally shown in FIG. 6, the handle 25 is structured and arranged to accommodate the battery 530 and the switch 20. The base platform 40 is structured and arranged to accommodate the wires (not shown) connecting the battery 530 and the switch 20 to the motor 520. The air frame body 45 includes the air chamber 505 structured and arranged downstream of the fan 510 and upstream of the HEPA filter 35. As shown in FIG. 6, the HEPA filter 35, when positioned within the filter chamber 545, may be maintained in proper position through abutment against the stop 540 and the end cap 525. The fan assembly, which includes the fan housing 515, the fan 510 and the motor 520, is structured and arranged to blow air into air chamber 505 where the air is equalized in pressure and then passed through the HEPA filter 35. Clean air is then directed at a target, e.g., a wet solution around a surgical area.

Figure 7A:
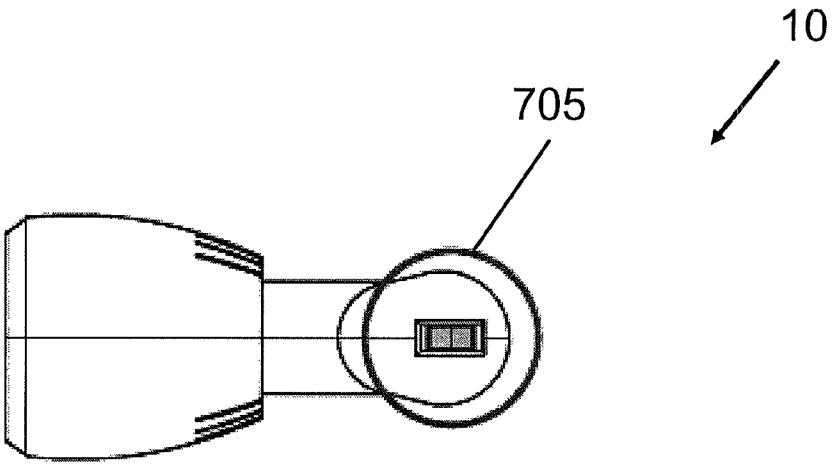
FIGS. 7A-7D illustrate how air flows through the exemplary body dryer in accordance with aspects of the present invention.
Figure 7B:
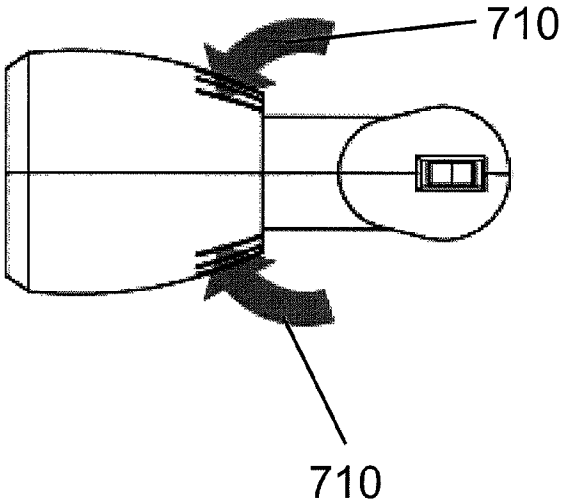
Figure 7C:
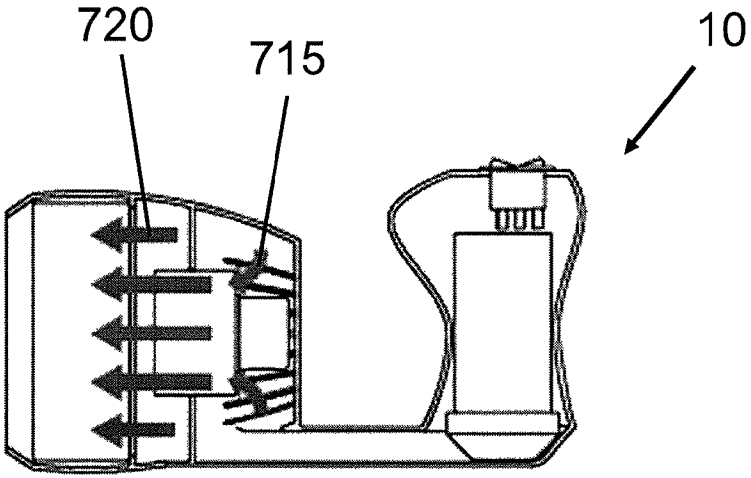
Figure 7D:
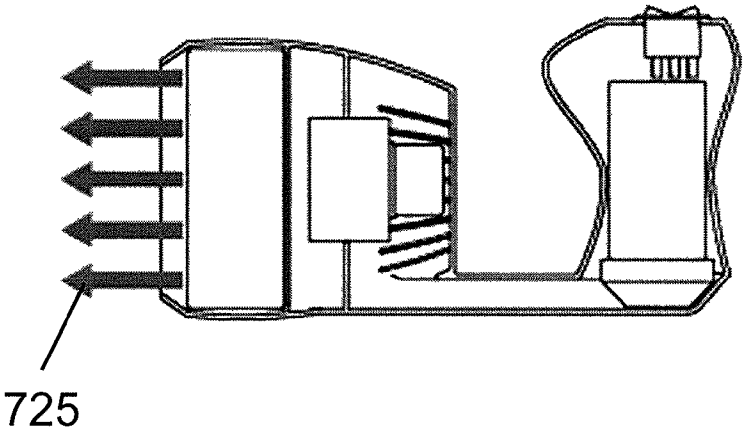

FIGS. 7A-7D illustrate how air flows through the exemplary body dryer 10 in accordance with aspects of the present invention. As shown in FIG. 7A, at step 705, the power switch is actuated to turn the air dryer 10 on. As shown in FIG. 7B, at step 710, air (i.e., unfiltered air) is drawn into the air dryer 10 through slots via actuation of the fan. As shown in FIG. 7C, at step 715, air is drawn into the fan assembly, and at step 720, air is forced into the filter. At step 725, air (i.e., filtered air) is passed out of the filter.

In operation, after a cleansing solution, for example, is placed on the patient at the surgical area, the dryer 10 is aimed at the site to quickly dry the solution. In embodiments having a battery, the hand-held dryer 10 provides for easy access to all parts of the body without an electrical wire potentially dragging across the surgical area or other sensitive part of a patient's body. In embodiments, the dryer 10 may be charged at a central station and then may be carried to distant locations in the hospital. The switch 20 actuates the dryer 10, which produces an air flow at room temperature directly through the air frame body 45 and onto the patient. Dust and other room particles are removed by the enclosed, removable HEPA filter 35. As a result of the reduced drying time of the cleansing solution, surgery can begin more quickly than the three to five minute wait required for air drying. The result allows surgeons to perform more procedures and the operating room to be more efficient.

In embodiments, the air dryer 10 may also be used by care givers on patients with sensitive skin, rashes or other skin irritations where a towel may cause chafing or discomfort. Moreover, towels may contain bacteria. Thus, implementing the present invention reduces towel usage in such situations, thereby reducing the potential for infection to occur. Additionally, using the air dryer 10 with open wounds will minimize contamination of the wound.

Implementing the present invention provides logistical and financial benefits. For example, the reduced need for cloth or paper towels, in most situations, will reduce the amount of energy needed over continuously washing and drying cloth towels or throw away paper products. For these reasons, the dryer 10 is suitable for use in hospitals, assisted-living homes, nursing facilities or at home, amongst other contemplated environments. The dryer is suitable for use on adults, children and infants.

In additional embodiments, the air dryer may include a UV lighting arrangement 550 structured and arranged within the air frame body 45. In accordance with aspects of the invention, the UV light is operable to further disinfect the air, and provides an additional level of decontamination of the intake air. While the non-limiting embodiment of FIG. 5 schematically illustrates the UV lighting arrangement 550 arranged in the air chamber, in embodiments, the UV lighting arrangement 550 may be arranged at the intake (e.g., in the region of the slots 30), within the air chamber 505, and/or in the end cap 525. Moreover, the UV lighting arrangement may be embodied as any known UV lighting arrangement (e.g., a ring light, a bank of LEDs, etc.).

In additional embodiments, the air dryer may include a heating arrangement 555 structured and arranged within the air frame body 45. In accordance with aspects of the invention, the heating element is operable to heat the air, and provides additional comfort to a patient and/or reduced drying times. While the non-limiting embodiment of FIG. 5 schematically illustrates the heating arrangement 555 arranged in the air chamber, in embodiments, the heating element may be arranged at the intake (e.g., in the region of the slots 30), within the air chamber 505, and/or in the end cap 525. Moreover, the heating arrangement may be embodied as any known heating arrangement (e.g., a heating coil, etc.).

While the invention has been described with reference to specific embodiments, those skilled in the art will understand that various changes may be made and equivalents may be substituted for elements thereof without departing from the true spirit and scope of the invention. In addition, modifications may be made without departing from the essential teachings of the invention. For example, while the invention has been described with reference to a HEPA filter, those skilled in the art will understand that other filters may be used.

What is claimed is:

1. A hand-held air dryer for supplying a decontaminated air stream, the air dryer comprising:

a hand-held housing forming a handle, an air frame body, and a base platform structured and arranged between the handle and the air frame body and connecting the handle to the air frame body;

a fan assembly structured and arranged in the air frame body; and an air filter arranged in the air frame body downstream of the fan assembly, wherein the air filter is structured and arranged to filter an incoming air stream thereby supplying the decontaminated air stream.

2. The air dryer of claim 1, wherein the air filter comprises a HEPA filter.

3. The air dryer of claim 1, further comprising a battery operable to power the fan assembly.

4. The air dryer of claim 3, wherein the battery comprises a rechargeable battery.

5. The air dryer of claim 1, wherein the air frame body includes one or more slots structured and arranged for receiving the incoming air stream.

6. The air dryer of claim 1, wherein the air frame body includes an air chamber arranged downstream of the fan assembly, that is structured and arranged for receiving the incoming air stream.

7. The air dryer of claim 1, wherein the air frame body includes a filter chamber structured and arranged to accommodate the air filter.

8. The air dryer of claim 7, further comprising an end cap structured and arranged for removable attachment to the air frame body, wherein the end cap maintains the air filter in the filter chamber.

9. The air dryer of claim 1, further comprising a UV lighting arrangement structured and arranged to disinfect the incoming air stream.

10. The air dryer of claim 1, further comprising a heating arrangement structured and arranged to heat the incoming air stream.

11. The air dryer of claim 1, wherein the air dryer is structured and arranged as a portable air dryer.

12. The air dryer of claim 1, wherein the housing comprises plastic.

13. The air dryer of claim 1, wherein the fan assembly comprises:

a fan;

a motor structured and arranged to rotate the fan; and a fan housing.

14. The air dryer of claim 1, further comprising a power switch operable to actuate the fan assembly.

15. A method of using a portable hand-held air dryer to supply a decontaminated air stream, the method comprising:

activating the air dryer to generate the decontaminated air stream; and supplying the decontaminated air stream to a liquid material disposed on a patient, wherein the supplying the decontaminated air stream to the liquid material accelerates a drying of the liquid material, and wherein the air dryer comprises:

a housing forming a handle, an air frame body, and a base platform structured and arranged between the handle and the air frame body and connecting the handle to the air frame body;

a fan assembly structured and arranged in the air frame body; and an air filter arranged in the air frame body downstream of the fan assembly at an airstream outlet of the air dryer, wherein the air filter is structured and arranged to filter an incoming air stream to supply the decontaminated air stream.

16. The method of claim 15, wherein the liquid material comprises a liquid solution for a surgical procedure, and the method further comprises applying the liquid solution to the patient.

17. The method of claim 15, wherein the liquid material comprises water.

18. The method of claim 15, wherein the air filter comprises a HEPA filter.

* * * * *